US007896279B2

(12) United States Patent
Comotto et al.

(10) Patent No.: US 7,896,279 B2
(45) Date of Patent: Mar. 1, 2011

(54) YARN BRAKING DEVICE

(75) Inventors: Renato Comotto, Biella (IT); Kurt Arne Gunnar Jacobsson, Ulricehamn (SE)

(73) Assignee: IRO AB, Ulricehamn (SE)

( * ) Notice: Subject to any disclaimer, the term of this patent is extended or adjusted under 35 U.S.C. 154(b) by 473 days.

(21) Appl. No.: 11/665,946

(22) PCT Filed: Apr. 28, 2005

(86) PCT No.: PCT/EP2005/004595

§ 371 (c)(1),
(2), (4) Date: Jun. 6, 2008

(87) PCT Pub. No.: WO2006/048053

PCT Pub. Date: May 11, 2006

(65) Prior Publication Data

US 2008/0296425 A1 Dec. 4, 2008

(30) Foreign Application Priority Data

Nov. 5, 2004 (DE) ..... 10 2004 053 542
Feb. 21, 2005 (DE) ..... 10 2005 007 842

(51) Int. Cl.
*B65H 51/20* (2006.01)
*D03D 47/34* (2006.01)

(52) U.S. Cl. ..... 242/365.4; 242/419.3; 242/419.4; 242/150 M; 139/194

(58) Field of Classification Search ..... 242/365.4, 242/418, 419, 419.3, 419.4, 422, 422.2, 147 M, 242/149, 150 M, 156, 156.1, 156.2; 139/100–115, 139/212–223, 194, 256 R, 257, 258, 349–358, 139/450–453
See application file for complete search history.

(56) References Cited

U.S. PATENT DOCUMENTS 5,778,943 A 7/1998 Tholander
5,979,810 A 11/1999 Barth

FOREIGN PATENT DOCUMENTS

DE 195 31 579 C1 1/1997

(Continued)

OTHER PUBLICATIONS

Machine Translation of WO-0236475.*

(Continued)

*Primary Examiner*—William E Dondero
(74) *Attorney, Agent, or Firm*—Flynn, Thiel, Boutell & Tanis, P.C.

(57) ABSTRACT

A yarn braking device includes a braking body with the shape of a frustocone coat. The braking body is put over a rounded withdrawal end of a storage body and is pressed from the small diameter end by a resilient axial force against the withdrawal end. The axial force defines the braking effect between the braking body and the withdrawal end. Between a stationary holder and the braking body an axial force generator and a centering device acting in radial direction are provided. The axial force generator is formed by at least one pair of permanent magnets. The permanent magnets are axially aligned by the centering devices with an intermediate gap. The centering device neither is an axial sliding guiding system structurally and functionally separated from the pair of permanent magnets, or is formed free of contact directly by the pair of permanent magnets, respectively.

20 Claims, 6 Drawing Sheets

FOREIGN PATENT DOCUMENTS

| | | | | |
|---|---|---|---|---|
| DE | 198 39 272 | A | | 4/1999 |
| EP | 0 534 263 | A | | 3/1993 |
| EP | 536088 | A1 | * | 4/1993 |
| EP | 0 652 312 | A | | 5/1995 |
| WO | WO 9964337 | A1 | * | 12/1999 |
| WO | WO 0236475 | A1 | * | 5/2002 |
| WO | WO 2007048528 | A1 | * | 5/2007 |
| WO | WO 2007079962 | A1 | * | 7/2007 |

OTHER PUBLICATIONS

International Search Report dated Aug. 9, 2005 (2 pages).

* cited by examiner

Fig.1
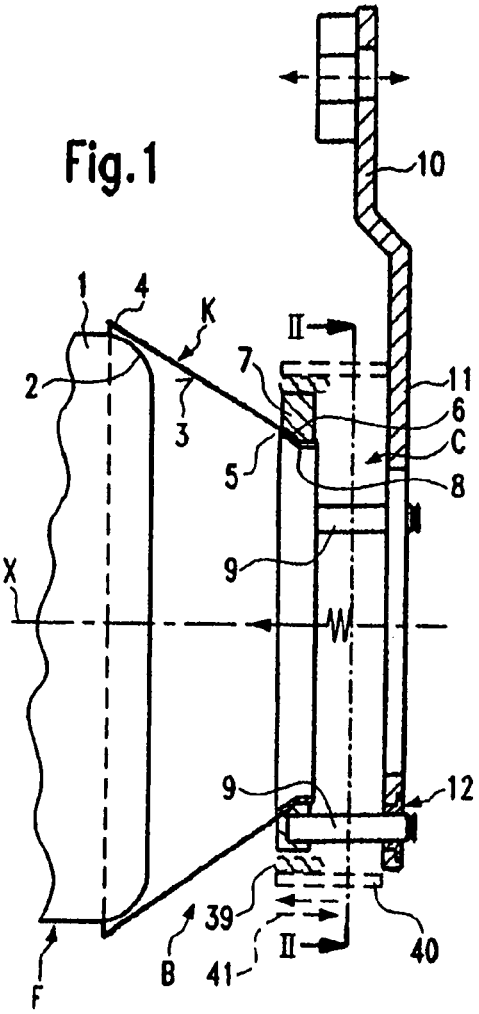
Fig.2
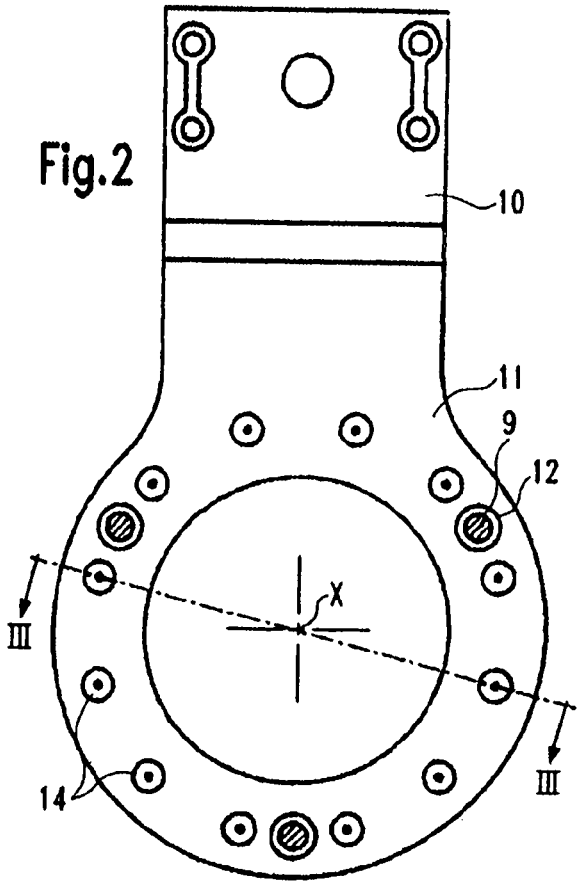
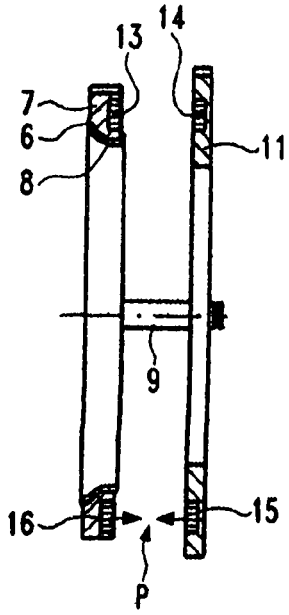
Fig.3

YARN BRAKING DEVICE

FIELD OF THE INVENTION

The invention relates to a yarn braking device.

BACKGROUND OF THE INVENTION

In a known yarn braking device (EP 0 534 263 A) a mechanical spring constitutes both the axial force generator and the radial centering device. The spring may be an annular radially oriented diaphragm, a radial spiral spring, a conical spiral spring, a cylindrical bellows, or, as shown in FIG. 1 of EP 0 652 312 A, a star-shaped spring arrangement consisting of helical tension springs each of which is hooked into the holder and into the support ring body, respectively. A general problem of mechanical springs is a development of the force which is not uniform in circumferential direction, the susceptibility to aggressive substances, and a tendency to collect lint. A further problem is that the mechanical spring at the same time has to centre in radial direction and has to transmit the axial force on the braking body. This dual function means a compromise between the development of the resilient axial force and of the radial centering force and might be critical in cases of extreme braking effects, i.e. if the same reliable centering of the frustocone braking body is necessary in case of an extremely weak braking effect or in case of an extremely strong braking effect. The adjustment range of the braking effect is limited by the nature of the mechanical spring, meaning that the mechanical spring has to be substituted by another as soon as a significant variation of the braking effect is needed. Basically, the braking effect is adjusted by the axial position of the holder in relation to the withdrawal end in order to load the spring more or less. In the case of a very weak braking effect due to the low spring load the centering and automatic return of the dislocated braking body into the centered position may fail, while in the case of an extremely strong adjustment of the braking effect the centering may be too rigid due to the high spring load. An optimal and constant centering effect and the capability of the braking body to automatically return after occurrence of a needed lateral displacement into a perfectly centered position on the withdrawal end of the braking body is, however, a decisive prerequisite for a correct braking function, since the large diameter end region of the frustocone braking body only then is able to produce a uniform braking effect along the circumference of the withdrawal end when the small diameter end of the frustocone braking body remains perfectly centered. Already small misalignments results in permanent fluctuations of the braking effect and in undesirable variations of the yarn tension. The yarn which rotates during withdrawal from the storage body in the yarn braking device like the hand of a clock in most cases is deflected in the support ring body and then applies a rotating, outwardly directed force on the braking body which force is varying, e.g. in case of a passing knot, and which has to be taken up and compensated permanently by the centering device. For that reason a properly operating centering device has a significant functional importance for this kind of a yarn braking device.

It is known from DE 195 31 579 A in a small diameter circular disc brake, which the yarn is only passing laterally, to press the braking discs against each other by axially repelling permanent magnet rings. However, due to the only linearly passing yarn the functional requirements for centering are low since the discs are centered mechanically and are inclined in relation to each other during operation.

Furthermore, it is known for controlled yarn braking devices (DE 198 39 272 A, EP 0 652 312 A, U.S. Pat. No. 5,778,943 A), the braking effect of which either can be modulated or can be switched off completely, to provide a magnetic axial force generator for a basic braking effect or passive position in combination with a mechanical spring arrangement. The axial force generator comprises at least one coil which is supplied with current. In the deenergised condition the axial force generator does not generate any force.

It is an object of the invention to provide a non-controlled yarn braking device of the kind mentioned in the beginning which is structurally simple and reliable, allows a broad adjustment range of the braking effect and which has good performance even in case of extremely weakly and extremely strongly adjusted braking effects.

This object is achieved according to one embodiment by providing a yarn braking device for a yarn feeding device, the yarn braking device having an axially stiff, radially deformable braking body with the shape of a frustocone, the large diameter end of the braking body being set coaxially over a rounded withdrawal end of a drum-shaped storage body and being pressed resiliently against the withdrawal end from the small diameter end by an axial force defining the braking effect between the braking body and the withdrawal end. An axial force generator acting in the axial direction and a centering device acting in the radial direction are also provided, respectively, between a stationary holder and the braking body. The axial force generator is formed by at least one pair of permanent magnets, the permanent magnets of which are aligned axially to each other by the centering device with an intermediate gap, and the centering device includes an axial sliding guiding system which is separated structurally and functionally from the pair of permanent magnets.

Pursuant to an additional embodiment of the invention, a yarn braking device for a yarn feeding device is provided, the yarn braking device having an axially stiff, radially deformable braking body with the shape of a frustocone, the large diameter end of the braking body being set coaxially over a rounded withdrawal end of a drum-shaped storage body and being pressed resiliently against the withdrawal end from the small diameter end by an axial force defining the braking effect between the braking body and the withdrawal end. An axial force generator acting in the axial direction and a centering device acting in a radial direction are also provided, respectively, between a stationary holder and the braking body. The axial force generator and the centering device at the same time are formed by at least one pair of permanent magnets, of which one inner permanent magnet is supported against the holder while the other outer permanent magnet of the pair is supported against the braking body, and the permanent magnets of the pair are aligned to each other via an intermediate gap and such that the direction of the action of the magnet force is inclined obliquely towards the axis of the yarn braking device. Further, the permanent magnets of the pair are generating both axial force components and also radial force components, respectively.

In accordance with the first embodiment, the pair of the permanent magnets operates without contact and with a function which is not liable to aging, to aggressive substances, to misalignments, does not tend to develop the force irregularly, and which assures a wide adjustment range for the braking effect. The pair of permanent magnets exclusively has to generate the resilient axial force which determines the braking effect while the needed centering of the frustocone braking body is carried out at the small diameter end section by the sliding guiding system. The produced centering effect is the same for all adjustments of the braking effect. Both functions, i.e. the generation of the axial resilient force and the axial guidance may by optimised respectively per se since these functions do not interfere with each other during the operation of the yarn braking device. The problem of lint collection and the negative influence of collected lint are eliminated. The structural construction of the yarn braking device is simple and results in high reliability as there are no liable mechanical spring components.

In the solution according to the second embodiment, the pair of permanent magnets at the same time forms the axial force generator and the centering device, i.e., the small diameter end of the braking body is supported without contact by magnet forces only, and at the same time is axially actuated against the storage body and is radially actuated from all sides in the direction towards the axis of the yarn braking device by radial force components of the magnet effect, and is centered accordingly. Since there is no mechanical contact the yarn braking device is characterised by a prompt and precise response behaviour. The at least one pair of permanent magnets in the yarn braking device forms, so to speak, a virtual or magnetic spring. The respective inner permanent magnet could be provided directly in the braking body or could be integrated even into the material of the braking body, respectively.

As it is decisive for the desired braking function that the precisely adjustable axial resilient force permanently actuates the always correctly centered frustocone braking body against the withdrawal end, the permanent magnets in the pair of permanent magnets could be provided such that they either repel or attract each other, and such that the available mounting space is optimally used.

In case of single pairs of permanent magnets at least three regularly distributed pairs should be provided.

Very uniform development of the force can be achieved by ring-shaped permanent magnets which co-act essentially on the same diameters or even on different diameters.

Alternatively, e.g. for weight reasons, more than three permanent magnet pairs each consisting of single permanent magnets could be distributed in circumferential direction. In this case either a provided axial sliding guiding system will form an anti-rotation mechanism for the permanent magnets within the pairs in order to always align the permanent magnets to each other, or the single permanent magnets could be designed such or/and arranged such that they automatically generate an anti-rotation effect by the magnetic co-action.

The support ring body of a specific embodiment in which the centering device simultaneously constitutes the anti-rotation mechanism, is held in an outer ring carrying at least three axial guiding pins which are distributed in circumferential direction. The support ring body carries either a ring-shaped permanent magnet or several single permanent magnets, respectively. The holder is formed with a ring section which is equipped with guiding sleeves for the guiding pins and which either is provided with a ring-shaped permanent magnet or with single permanent magnets in a multiple arrangement. Alternatively, the guiding pins also may be anchored in the ring section of the holder, while the guiding sleeves then will be provided in the outer ring. The guiding pins should penetrate the guiding sleeves with a weak slide fit.

In a further expedient embodiment the outer ring is formed at the inner side with a conical seat for the small diameter end of the braking body. The support ring body is a snap ring which is snapped into the outer ring in order to position the braking body in the seat. This is advantageous in terms of assembly and allows, if needed, a prompt and comfortable replacement of the braking body.

In a further expedient embodiment the support ring body is secured at a small diameter ring edge of a generally conical cage the large diameter end region of which either is equipped with a ring-shaped permanent magnet or with several single permanent magnets, respectively, and which surrounds the braking body with radial distance. The cage is loosely inserted into a support ring which either includes the other ring-shaped permanent magnet or several single permanent magnets, respectively, and which is provided with axial holder feet which are distributed in circumferential direction. The inner sides of the holder feet define axial sliding guiding surfaces for a counter guiding surface at the outer periphery of the large diameter end region. In the case of ring-shaped permanent magnets an anti-rotation mechanism is not needed. To the contrary, an anti-rotation mechanism may be expedient in case of single permanent magnet pairs, e.g. between the cage and the support ring or between the sliding guiding surfaces and the counter guiding surface. The counter guiding surface may be concavely rounded in an axial section of the cage such that an axially shiftable universal joint or ball joint is formed between the counter guiding surface and the axial guiding surfaces of the holder feet. The universal joint or ball joint, respectively, allows the operation movements of the radially deformable braking body without interference and properly centers the small diameter end of the braking body.

With a view to a comfortable assembly the holder feet are snap holders having an integrated predetermined bending elasticity for a snap fixation at the ring section of the holder. The cage and the holder feet offer sufficient intermediate spaces such that lint does not collect there, or such that access is provided at any time for cleaning purposes or for an inspection.

With a view to easy assembly the support ring body should be formed with an outside seat for the small diameter end section of the braking body. The seat is bounded on one side by a shoulder such that the support ring body can be snapped into the ring edge of the cage in order to position the braking body. The seat could be formed partially or in its entirety in the ring edge of the cage.

In a particularly expedient embodiment which operates without a mechanical axial sliding guiding system each outer single or the ring-shaped permanent magnet is arranged in relation to the axis on a larger diameter than each inner single permanent magnet or the inner ring-shaped permanent magnet. The permanent magnets of the pair or of the pairs, e.g. respectively repelling permanent magnets, co-operate such that forces are generated which are directed obliquely to the axis and such that radial force components of the forces can be used for the centering while the axial force components are used to generate the resilient axial force. The trick of arranging the outer permanent magnet or the outer permanent magnets, respectively, on a larger diameter than the inner permanent magnet or the inner permanent magnets, respectively, results in the effect that the inner permanent magnet in case of a displacement outwardly away from the axis will be exposed to an increasing counter oriented radial force component and then is pressed back with force again in the direction towards the axis. That means that the respective maximum centering radial force component only is generated then when the inner permanent magnet tends to displace outwardly. In this fashions the inner permanent magnet or the inner permanent magnets, respectively, are captured in the magnetic fields of the outer permanent magnets or the outer permanent magnet, respectively, provided that the braking body is contacting the withdrawal rim of the storage body under axial force. The small diameter end of the braking body remains properly centered even in case of forces which act radially outwardly and originate e.g. from the deflection of the yarn at the support ring body or from the passage of a knot.

In a preferred embodiment the repelling surfaces of the repelling permanent magnets of the pair which repelling surfaces face each other, are inclined obliquely with respect to the axis, even, preferably, are formed conically, and are at least substantially parallel to each other. The radial and the axial force components are generated already by this design of the permanent magnets.

In an expedient embodiment having two ring-shaped permanent magnets the permanent magnets may be conical rings having a rectangular or trapezoidal cross-section. Already by this form of the permanent magnets the direction of the magnetic action is inclined obliquely towards the axis of the yarn braking device and uniformly along the circumference such that the multiple effect of radial force components and of axial force components is achieved. The radial force components act counter to an outward displacement of the small diameter end and increase the stronger the more the small diameter end is displaced outwardly.

In an expedient embodiment having single permanent magnets in several pairs distributed along the circumference the outer single permanent magnets are offset in circumferential direction relative to the inner single permanent magnets such that each outer single permanent magnet is directed into the gap between adjacent inner single permanent magnets or vice versa. Since then each inner single permanent magnet at the same time is actuated by the magnetic forces of two outer single permanent magnets from different directions the co-acting permanent magnets automatically constitute a contact free magnetic anti-rotation protection mechanism. Also in this case the inner single permanent magnets ought to be arranged on a smaller diameter than the outer single permanent magnets in order to achieve the necessary centering and return functions.

In an expedient embodiment the support ring body carries the single inner permanent magnets or the ring-shaped inner permanent magnet, respectively. A conical support cage which grips over the small diameter end of the braking body and which is secured, preferably detachably, at the holder carries the single permanent magnets or the ring-shaped outer permanent magnet, respectively, on a carrying ring. This solution is of advantage with a view to easy manufacturing and easy assembly.

In a further expedient embodiment a cylindrical extension of the frustocone is formed at the small diameter end of the braking body. This measure avoids local overloads at the small diameter end when actuated by the axial force and allows a simple assembly e.g. by only tucking the braking body loosely into the support ring body.

In a further expedient embodiment an essentially cylindrical extension is provided at the support ring body. The cylindrical extension extends through the carrying ring of the support cage without contacting the carrying ring. This measure stiffens the support ring body and allows to limit the displacement of the braking body in an emergency case under extreme sideward displacement. During normal operation of the yarn braking device, however, there will not be any contact between the extension and the carrying ring.

It is important for the above-mentioned reasons that an intermediate distance is generated in the direction of the magnet action between the support ring body and the carrying ring of the support cage, the intermediate distance being at least as large as the size of the air gap between the permanent magnets.

An advantageous handling is achieved when the cylindrical extension of the support ring body at the end protruding beyond the carrying ring of the support cage is equipped with an outwardly directed catching projection, e.g. a ring flange the outer diameter of which is slightly larger than the inner diameter of the carrying ring. During assembly the support ring body first is put against resistance into the carrying ring. During the normal operation of the yarn braking device, i.e., as soon as the braking body abuts at the storage body, the catching projection does not engage at the carrying ring. However, during assembly or during transport, the engagement of the catching projection at the carrying ring assures that the support ring body and the braking body cannot fall out of the carrying ring.

The magnitude of the axial force of the axial force generator is adjusted by the axial position of the holder in relation to the withdrawal end of the storage body. In order to allow to change the adjusted magnitude of the axial force generated between the permanent magnets precisely and remotely controlled and without manual engagement at the adjustment device of the holder, in an expedient embodiment at least one coil is functionally associated to one of the permanent magnets of the axial force generator in order to allow to generate an auxiliary magnet force which is superimposed on the axial force by selectively supplying current to the coil. The auxiliary magnet force increases or reduces the axial force to a desired extent. So to speak, one of the permanent magnets provided anyway for the suspension of the braking body is used as an armature of a selectively controlled electromagnet. Since the permanent magnets generate a relatively strong axial force a coil and/or a moderate current may be sufficient, which are not particularly strong, to adjust in some cases only a weak increase or decrease of the axial force. The axial effect of the coil or of several coils can be amplified by correspondingly placed iron, preferably soft iron. This embodiment is particularly expedient for a knitting machine, in particular a circular knitting machine at which frequently many yarn feeding devices are installed and where during operation fluctuations in the quality of the knitted fabric may occur which promptly could be compensated for by a change of the braking effect or the knitting yarn tension, respectively. By means of the coils in the yarn braking devices then the axial forces can be changed independently from the value of the respective axial force in one group of or in all yarn feeding devices, respectively, such that by this measure and substantially at the same time the tensions in the knitting yarns are raised or lowered by essentially the same amount.

In a further embodiment the coil is arranged stationarily outside of the braking body and in association to the permanent magnet of the axial force generator which permanent magnet is supported at the braking body. In this case the permanent magnet provided anyway in the axial force generator is used without additional measures for this additional function.

In a further embodiment the coil is supported at the braking body and is functionally associated to the permanent magnet which is provided outside the braking body. The coil is lightweight such that the mass of the braking body remains low. The permanent magnet provided outside the braking body anyway is part of the axial force generator and can be used for this additional function without additional structural measures.

In a yarn braking device the braking body of which is arranged via a support ring body in a support cage the coil expediently is provided in the support cage or at the support ring body, respectively. Thanks to this placement the coil is located optimally close to the permanent magnet.

DESCRIPTION OF THE DRAWINGS

Embodiments of the invention will be explained with the help of the drawings wherein:

FIG. 1 is a side view, in partial section, of a first embodiment of a yarn braking device, FIG. 2 is a sectional view taken along plane II-II in FIG. 1, FIG. 3 is a sectional view taken along plane in FIG. 2.

DETAILED DESCRIPTION

Figure 4:
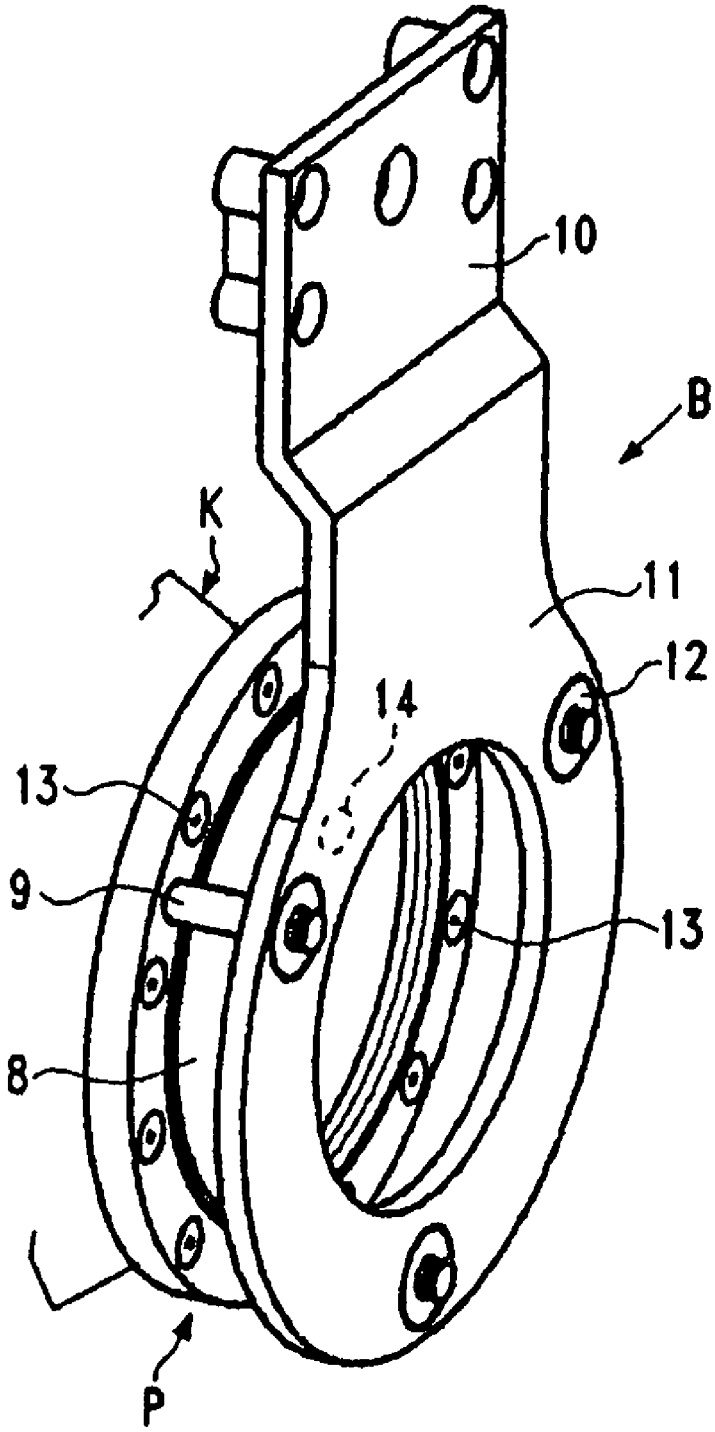
FIG. 4 is a perspective view of the yarn braking device of FIGS. 1 to 3.

A first embodiment of a non-controlled yarn braking device B, shown in FIG. 4 in a perspective view, is explained with the help of FIGS. 1 to 4. The yarn braking device B is mounted in a yarn feeding device F (FIG. 1) comprising a drum-shaped stationary storage body 1 having a rounded withdrawal end 2 and an axis X which is also the axis of the yarn braking device B. A braking body K with the form of a frustocone 3 (having a straight line as a generatrix) is provided in the yarn braking device B. The braking body K is put with the large diameter end 4 over the withdrawal end 2 and is pressed against the withdrawal end 2 by an axially resilient force. The axially resilient force defines the braking effect for the yarn in the contact region between the inner side of the frustocone 3 and the withdrawal end 2. During the withdrawal and the run through the yarn braking device the withdrawn yarn is circulating like the hand of a clock. The braking body K e.g. is made from plastic material with or without enforcement, from metal or from a mesh fabric or lattice fabric. In some cases an inner circumferentially continuous braking coating made of wear resistant material may be provided in the braking zone although the inner surface of the braking body K as well may be directly used for braking the yarn. The yarn braking body K is axially relatively stiff but radially easily deformable such that it embraces the withdrawal end 2 and is able to form a wave following the yarn which consequently revolves along the withdrawal rim. The deformability of the braking body K also allows knots to pass through the braking zone.

A small diameter end 5 of the braking body K is secured in this embodiment at a support ring body 8. The support ring body 8 has at the inner side a low friction and wear resistant surface for contact with the yarn which is deflected in this location. The support ring body 8 is formed as a snap ring and is snapped into the inner side of an outer ring 7. The outer ring 7 (or the support ring body 8) has a conical seat 6 for the small diameter end 5 of the yarn braking body K. The yarn braking body K is replaceably positioned loosely by the snapping effect between the support ring body 8 and the outer ring 7.

In the yarn feeding device, which is not shown in detail, a holder 10 is supported stationarily with axial distance from the outer ring 7. The holder can be adjusted parallel to the axis X. The holder has a ring section 11 forming a passing opening for the withdrawn yarn. A centering device C is provided between the holder 10 and the support ring body 8 which centering device C centers the small diameter end 5 of the yarn braking body on the axis X. In this embodiment, the centering device C, at the same time, constitutes an anti-rotation protection mechanism limiting or suppressing the relative rotation between the outer ring 7 and the holder 10. Furthermore, an axial force generator P is provided (FIG. 3) between the outer ring 7 and the holder 10. The axial force generator P resiliently produces the axial force between the holder 10 and the yarn braking body K which axial force is decisive for the braking effect.

The centering device C in FIGS. 1 to 4 consists of several axial guiding pins 9 which are distributed in circumferential direction and, in this case, are anchored in the outer ring 7. The guiding pins 9 are inserted with a weak slide fit into guiding sleeves 12 which are provided in the ring section 11 of the holder 10. Expediently, a very small radial clearance is provided between the guiding pins 9 and the guiding sleeves 12. The positions of the guiding pins 9 and the guiding sleeves 12 could be inverted as well.

The axial force generator P is constituted in this embodiment by repelling permanent magnets 13, 14 which are aligned with each other pairwise and in axial direction. Single permanent magnets 13 are contained in pockets 16 of the outer ring 7, while pockets 15 at the ring section 11 which pockets 15 are axially aligned with the pockets 16 also contain single permanent magnets 14.

The adjustment of the axial force between the permanent magnets 13, 14 pressing the braking body K against the withdrawal end 2 is carried out by the axial positioning of the holder 10 relative to the withdrawal end 2.

In the shown embodiment three guiding pins 9 are provided with equal distances)(120°). The guiding pins 9 are structurally and functionally separated from the permanent magnet pairs. Furthermore, twelve regularly distributed)(30°) permanent magnet pairs 13, 14 are provided. The number of guiding pins 9 and/or of permanent magnet pairs as well may be selected differently.

Although this is not shown in FIGS. 1 to 4, two ring-shaped, one-piece permanent magnets could be provided instead of several single permanent magnet pairs 13, 14. The ring-shaped permanent magnets could be made e.g. from a mass which is bonded by plastic material and which can be magnetized. In a further, not shown, modification of the embodiment of FIGS. 1 to 4 permanent magnet pairs could be used the permanent magnet of which pairs are attracting each other. This could be realized e.g. by placing a ring like the outer ring 7 on ends of the guiding pins 9 which ends extended beyond the holder 10 and by mounting other attracting permanent magnets at the ring. For example, neodymium permanent magnets or ferrite permanent magnets are particularly suitable.

A detail variant of the yarn braking device is indicated in dotted lines in FIG. 1. A coil 39 which selectively can be supplied with current is magnetically and functionally associated to the permanent magnets 13 which transmit the axial force of the axial force generator P to the braking body K at the outer side such that with current supplied to the coil 39 an auxiliary magnet force 41 can be generated which has essentially the same or the opposite direction of action like the axial force by which auxiliary magnet force 41 the value of the axial force can be increased or decreased. The coil 39 e.g. is placed at a carrier 40 provided at the ring section 11.

Figure 5:
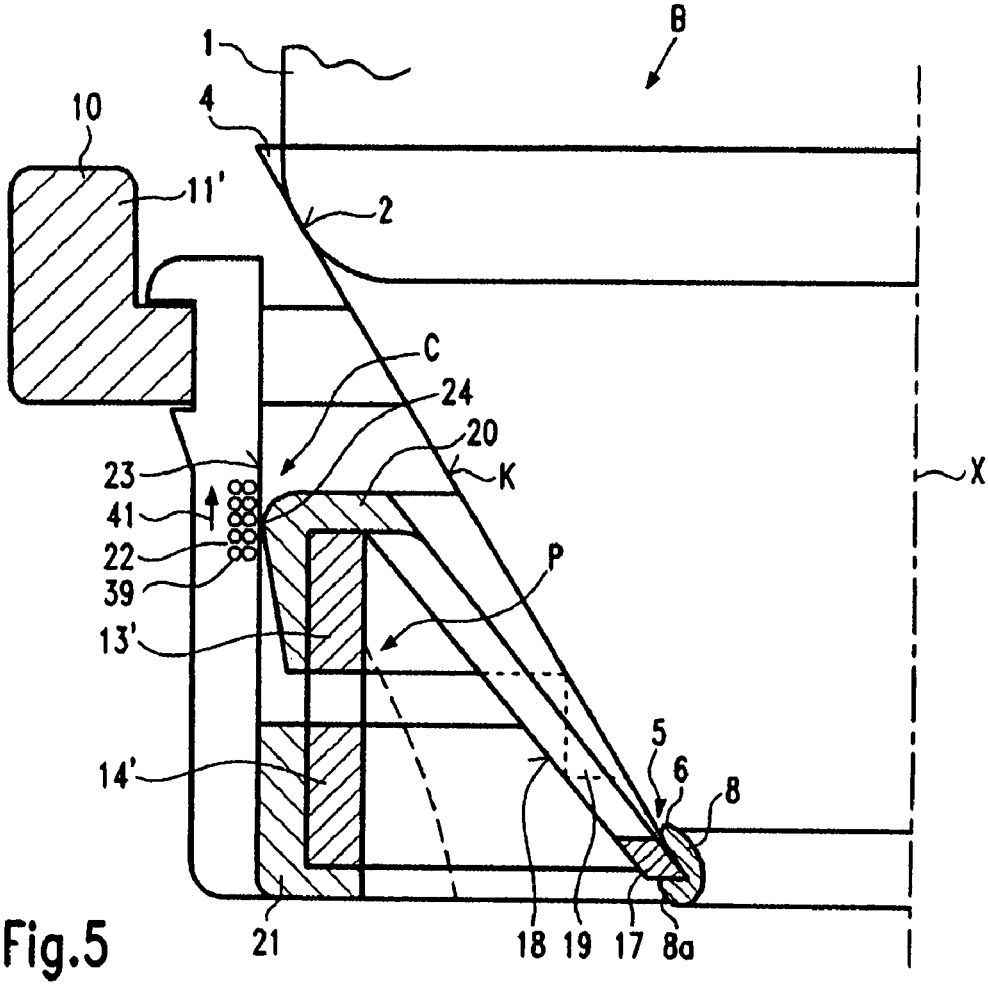
FIG. 5 is a part of an axial sectional view of another embodiment of a yarn braking device.
Figure 6:
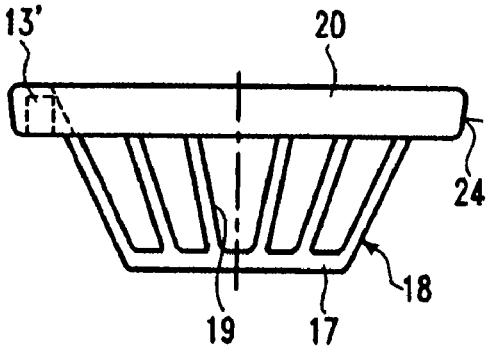
FIG. 6 is a side view of a detail of the yarn braking device of FIG. 5.
Figure 7:
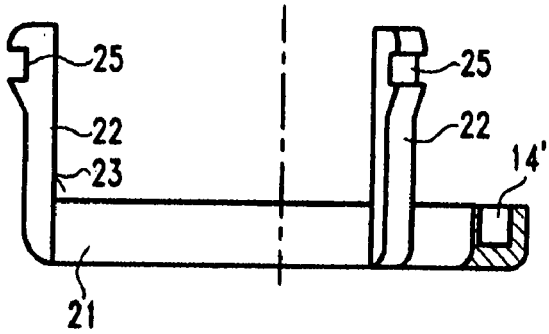
FIG. 7 is a side view of a further detail of a yarn braking device of FIG. 5.

In the yarn braking device B in FIGS. 5 to 7 an anti-rotation protection mechanism is dispensed with in comparison to the embodiment of FIGS. 1 to 4. The holder 10 is positioned with its ring section 11' very close to the withdrawal end 2 of the storage body 1 at the yarn feeding device (not shown). By this arrangement mounting space is saved at the other side of support ring body 8 which is provided in some cases.

In this embodiment the braking body K is positioned with the small diameter end 5 engaged in a conical seat 6 which is formed in this case in the support ring 8. The seat is bounded by a shoulder 8*a*. A generally conical cage 18 is supported on the shoulder 8*a* via a ring edge 17. The ring edge 17 is snapped into the seat 6 in order to secure the small diameter end 5 of the braking body K. The cage 18 is formed with a cone angle which is larger than the cone angle of the braking body K. Furthermore, the cage 18 is provided with several spokes 19 emanating from the ring edge 17 and leading to a ring-shaped large diameter end region 20. So to speak, the braking body K is sunk into the cage 18 at least with a part of its longitudinal extension.

The large diameter end region 20 of the cage 18 contains a ring-shaped permanent magnet 13' which is aligned axially by the centering device on a further ring-shaped permanent magnet 14'. The ring-shaped permanent magnet 14' is held in a support ring 21. The support ring 21 has axial and regularly distributed holder feet 22 at the outer side extending in the direction of the large diameter end 4 of the braking body K. The holder feet 22 are formed as snap holders with integrated predetermined bending elasticity and are snapped into the ring section 11' of the holder 10. Axial guiding surfaces 23 for co-action with a counter guiding surface 24 at the outer periphery of the large diameter end region, e.g. formed with a circumferentially continuous extension 20, are provided at the inner walls of the holder feet 22. The guiding surfaces 23, 24 constitute the centering device C. The counter guiding surface 24 e.g. is convexly rounded as shown in order to create the function of an axially movable universal joint or ball joint, respectively, for centering the braking body K.

In a not shown modified embodiment of FIGS. 5 to 7 instead of the two ring-shaped permanent magnets 13', 14' several single permanent magnet pairs could be provided similar to FIG. 2. In this case it is expedient to also integrate an anti-rotation protection mechanism into the centering device C, e.g. by means of a circumferential form fit co-action between the guiding surfaces 24, 23.

In the embodiment in FIGS. 5 to 7 respective repelling permanent magnets are provided. In a not shown modification instead respectively attracting permanent magnets could be used, e.g. by securing one permanent magnet ring at the upper end of the holder feet 22 which attracts the other ring-shaped permanent magnet which then is provided in the large diameter end region 20. The cage 18 is loosely inserted with the braking body K into the structure defined by the holder feet 22 and the support ring 21. A replacement of the braking body K is possible after detaching the holder feet 22 from the ring section 11'. In this case either the braking body K is changed together with the cage 18 as one unit, or only the braking body K is replaced after detaching the support ring body 8 from the ring edge 17, respectively.

The spokes 19 (FIG. 6) of the cage 18 allow permanent visual inspection or cleaning of the inner components, because the holder feet 22 form large dimensioned intermediate spaces. Except for the permanent magnets, all components of the yarn braking device could be plastic formed parts. This is true also for the embodiment of FIGS. 1 to 4.

A detail variant of the yarn braking device B is indicated in FIG. 5. At least one coil 39 is provided in the holder feet 22 such that it co-acts magnetically with the permanent magnet 13' when current is supplied. The coil 39 superimposes an auxiliary magnet force to the axial force generated between the permanent magnets 13', 14'. The auxiliary magnet force either has the same or the opposite direction of action as the axial force. The coil 39 in FIG. 5 is arranged such that it generates an auxiliary magnet force 41 which increases the axial force when the coil 39 is under current.

In the embodiments of FIGS. 8 to 17 the axial force generator P and the centering device C at the same time are formed free of contact by the permanent magnet pairs. The permanent magnets (either two rings or several pairs of single permanent magnets distributed in circumferential direction) co-operate with a magnet effect which is directed obliquely to the axis X. Preferably, respectively repelling permanent magnets are used, although (not shown) respectively attracting permanent magnets could be used if arranged accordingly.

Figure 8:
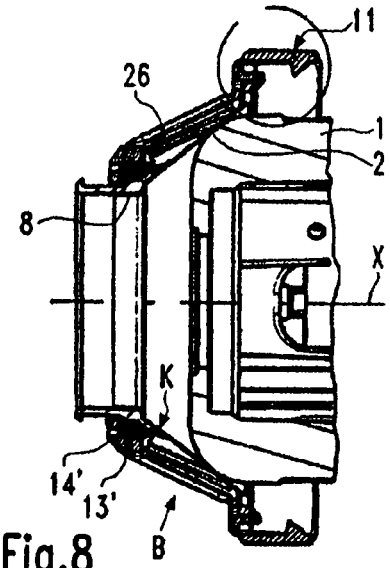
FIG. 8 is an axial section of a further embodiment of a yarn braking device.

The axial section in FIG. 8 shows the operative position of the yarn braking device B with the yarn braking body K axially resiliently pressed against the withdrawal rim 2 of the storage body 1. The support ring body 8 is provided in the small diameter end of the yarn braking body K. The support ring body 8 optimally may be formed with a cylindrical extension. The support ring body 8 carries at the outer side the ring-shaped permanent magnet 13' to which a ring-shaped permanent magnet 14' is aligned essentially axially. The ring-shaped permanent magnet 14' is held in a support cage 26. As will be explained with the help of FIGS. 9, 10 and 16, in this case the repelling permanent magnets 13', 14' are arranged such, and/or are constructed such, that the magnet effect is directed obliquely to the axis X of the yarn braking device B and such that by the magnet effect inwardly directed radial force components and axial force components in the direction towards the storage body are generated. The permanent magnet 13' could be directly provided at the braking body K or could be integrated in the material of the braking body K, respectively (e.g. made from magnetplast).

Figure 9:
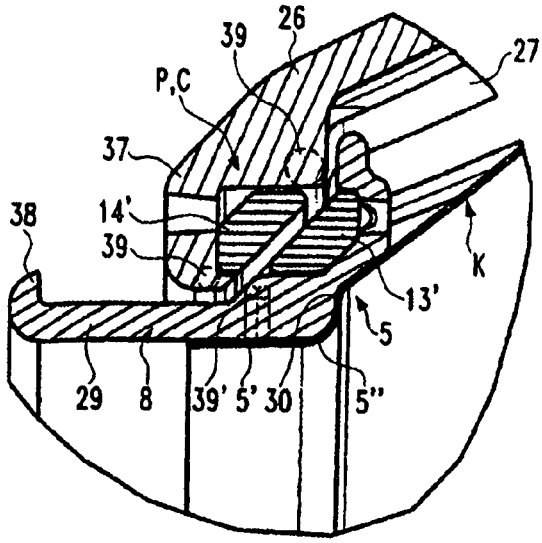
FIG. 9 is a detail of FIG. 8 in enlarged scale and in an axial section.

The support cage 26 as partially shown in FIG. 9 (with intermediate spaces between the spokes 27) has a circumferential continuous carrying ring 37 at the smaller diameter end. The ring-shaped permanent magnet 14' formed as a conical ring of trapezoidal cross-section is positioned inside the carrying ring 37 such that a flat or conical repelling surface (the broader base of the trapezoid) is inclined relative to the axis with an angle which e.g. amounts to about 45°. The ring-shaped permanent magnet 13', also being a conical ring having trapezoidal cross-section and a flat or conical repelling surface at the broader base of the trapezoid is aligned essentially axially to the ring-shaped permanent magnet 14'. The permanent magnet 13' is secured in the support ring body 8, the cylindrical extension 29 of which extends without contact coaxially through the carrying ring 37. An air gap is formed between the repelling surfaces of the permanent magnets 13', 14'. The radial distance between the extension 29 and the carrying ring 37 is essentially as large as the width of the air gap. A catching projection 38 is formed at the free end of the extension 29, e.g. a hook-shaped outer flange, the outer diameter of which is slightly larger than the inner diameter of the carrying ring 37. The support ring body 8 consists of elastic material, e.g. plastic material. The elasticity of the material allows introduction of the catching projection 38 into the carrying ring 37 by overcoming a certain resistance. However, the support ring body 8 only can be pulled out from the carrying ring 37 with significant force and such that it cannot fall out later by itself from the carrying ring 37 or the support cage 26, respectively.

The braking body K is equipped at the small diameter end 5 with a cylindrical extension 5' which is connected to the small diameter end 5 via an inwardly rounded shoulder such that a rounded yarn deflection shoulder 5" is formed which is lined with the material of the braking body K. Furthermore, a seat 30 for the yarn braking body K is formed in the support ring body 8. The yarn braking body K either is only inserted loosely into the support ring body 8 such that in case of a needed replacement of the braking body K the support ring body 8 can be re-used, or in some cases may be bonded, e.g. glued to the support ring body 8.

Due to the essentially parallel repelling surfaces of both permanent magnets 13', 14' which both are inclined obliquely the repelling force acts obliquely to the right side and downwards to the axis X such that the axial force for pressing the braking body K against the withdrawal rim 2 and at the same time the radial force components for centering the small diameter end 5 of the braking body K are generated by the magnet effect and such that no mechanical contact occurs between the support ring body 8 and the carrying ring 37.

Dotted lines in FIG. 9 indicate that two coils 39, which may be supplied with current selectively, are situated in the small diameter end of the support cage 26 such that they are functionally associated to the permanent magnet 13' and that they generate an auxiliary magnet force at the permanent magnet 13' when supplied with current. As an alternative, the coil 39' as well could be placed at the braking body K or the support ring body 8, respectively, and could be functionally associated to the stationary permanent magnet 14', in order to generate the necessary auxiliary magnet force.

Figure 10:
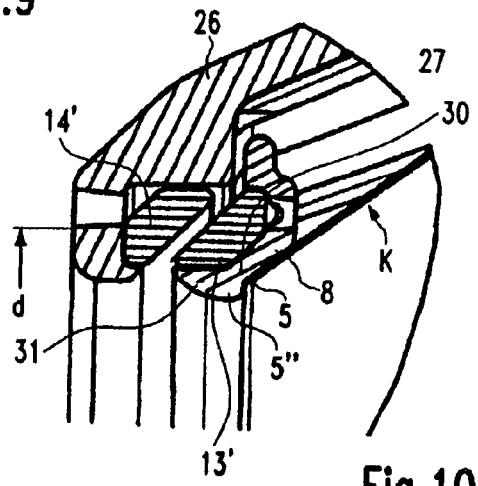
FIG. 10 is a detail variant, in a section similar to FIG. 9.

As the yarn braking device B does not need a mechanical centering device or axial guiding device, respectively, when the permanent magnets 13', 14' as well constitute the centering device C, the support ring body 8 in the embodiment of FIG. 10 is formed without a cylindrical extension 29 as shown in FIG. 9. With this measure the moving masses are reduced. The support ring body 8 may form the shoulder region 5" for deflecting the yarn. The braking body K is inserted with the small diameter end 5 directly into the seat 30 of the support ring body 8, in some cases only loosely, or in other cases bonded thereto. Both permanent magnets 13', 14' are cooperating in this case on the same diameter d on which, so to speak, the magnetic force centers of both permanent magnets 14', 13' are situated.

Figure 11:
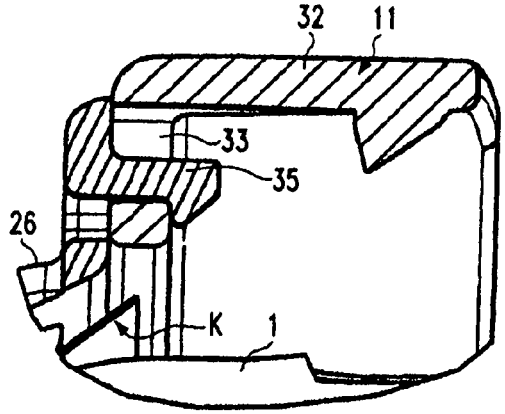
FIG. 11 is an axial section of a detail indicated by a circle in FIG. 8.

FIG. 11 illustrates the detachable fixation of the support cage 26 in the holder ring body 11 which is part of a holder (not shown), such as the holder 10 as shown in FIG. 1. The ring body 11 has a flange 32 with insertion openings 33 for latching tongues 35 of the support cage 26. The latching tongues 35 are hooked in easily detachable fashion behind a shoulder.

Figure 12:
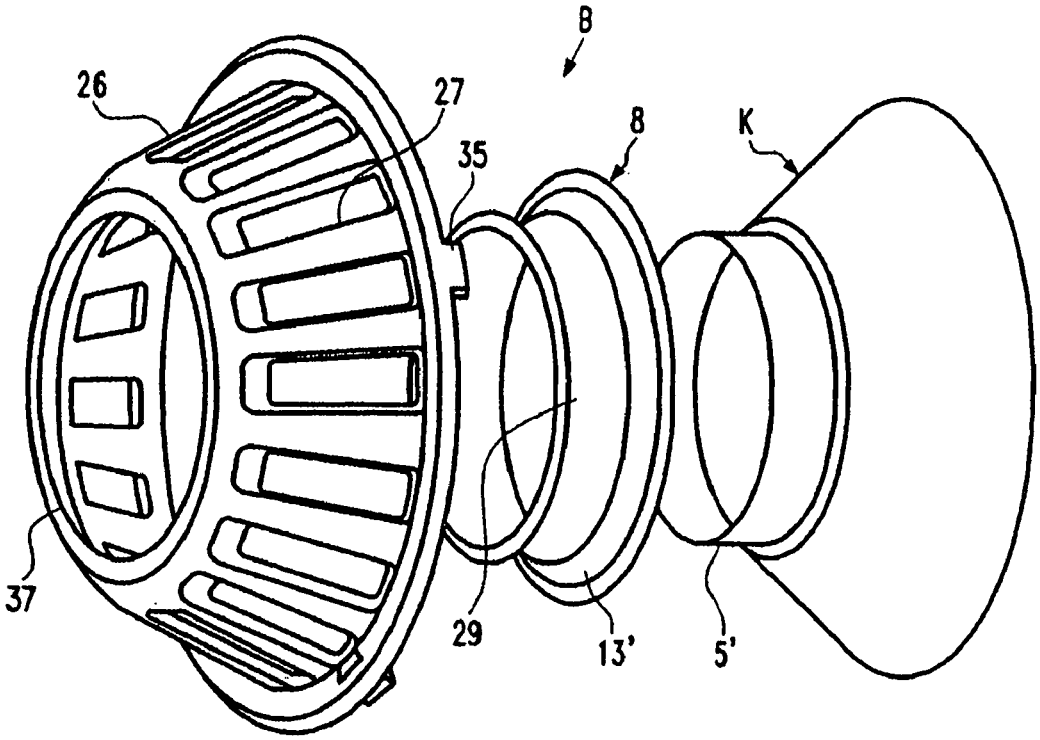
FIG. 12 is an exploded perspective illustration of the main components of the yarn braking device of FIG. 8.

The exploded illustration in FIG. 12 shows the arrangement of the main components of the yarn braking device e.g. of FIGS. 8 and 9 with the support cage 26 having the spokes 27, the latching tongues or latching hooks 35 and the carrying ring 37, the support ring body 8 having the extension 29 and finally the braking body K having the cylindrical extension 5' shown in FIG. 9. The inner ring-shaped permanent magnet 13' is fixed at a shoulder region of the support ring body 8, e.g. by gluing or by a snap fit.

Figure 13:
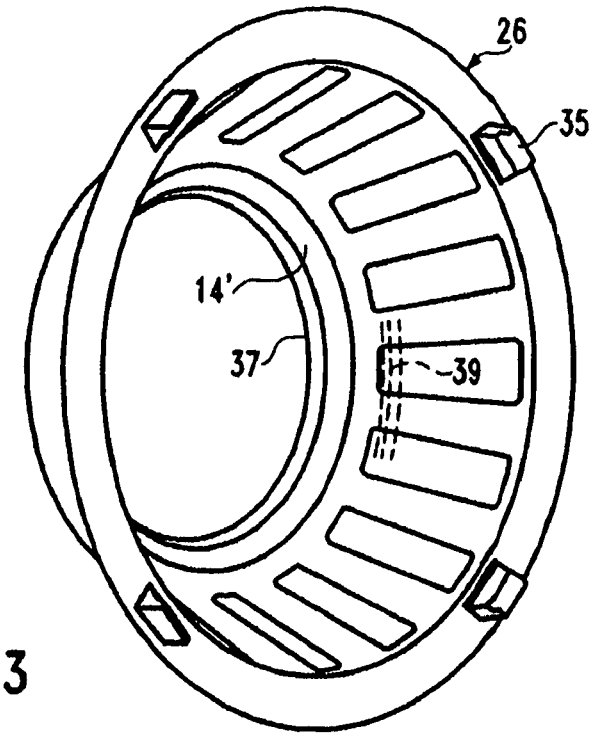
FIG. 13 is another perspective view of a component of FIG. 12.

FIG. 13 illustrates the positioning of the outer ring-shaped permanent magnet 14' on the inner side of the carrying ring 37 of the support cage 26. The permanent magnet 14' either is glued in or is snapped in. Since the support ring body 8 and the support cage 26 may be injection moulded parts of plastic material the permanent magnets 13', 14' even may be embedded and positioned during by the injection moulding process. The coil 39 (in some cases even several coils) may be placed inside the support cage 26.

Figure 16:
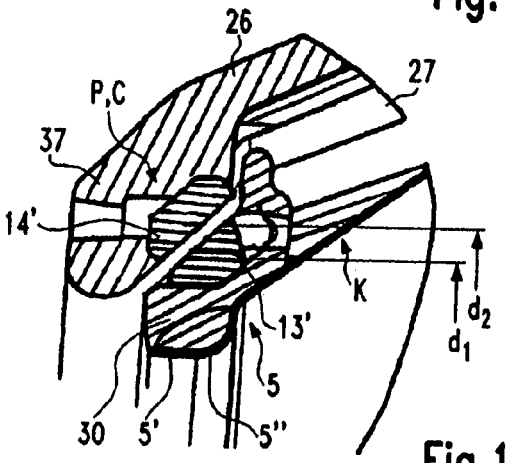
FIG. 16 is a detail variant similar to FIGS. 9 and 10, and FIG. 17 schematically shows a detail variant of a further embodiment of a yarn braking device.

FIG. 16 shows a modified detail variant of the yarn braking device of FIGS. 8, 9 and 10. The outer ring-shaped permanent magnet 14' has a larger diameter d2 and the inner ring-shaped permanent magnet 13' has a smaller diameter d1. The remaining design corresponds with the design as explained with the help of FIGS. 9 and 10. The permanent magnets 13', 14' repel each other. Since the outer permanent magnet 14' is acting on the diameter d2 which is larger than d1, the radial component of the repelling force increases when the small diameter end 5 of the braking body K in FIG. 16 e.g. tends to become displaced upwardly such that an expanded radial range exists within which the inner permanent magnet 13' is forced back and centered by the outer permanent magnet 14'. This returning force action is stronger the more the inner permanent magnet 13' is displaced upwardly.

Figure 14:
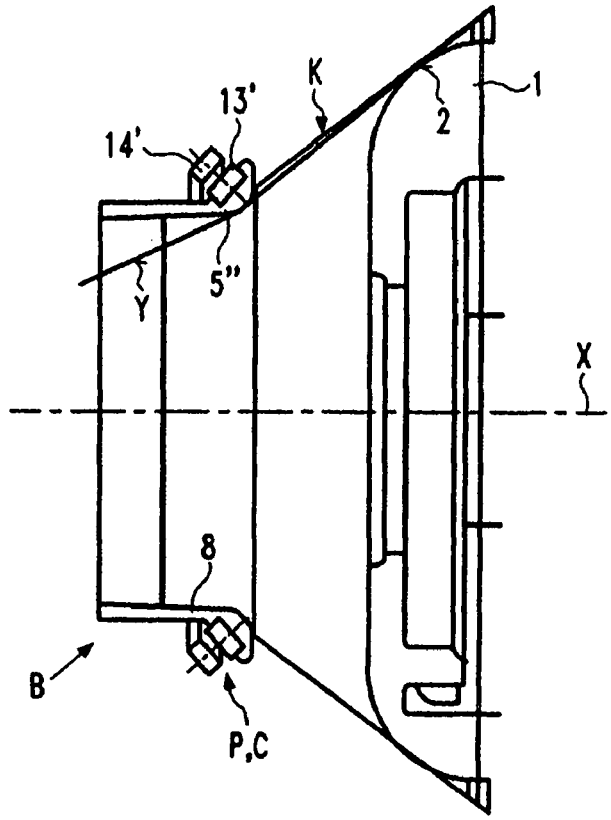
FIG. 14 is a schematic axial section of a still further embodiment of a yarn braking device.

In the embodiment of the yarn braking device B shown in FIG. 14 two ring-shaped permanent magnets 13', 14' (repelling permanent magnets) are provided in the form of conical rings having a rectangular cross-section. The permanent magnets 13', 14' at the same time constitute the axial force generator P and the centering device C.

Figure 15:
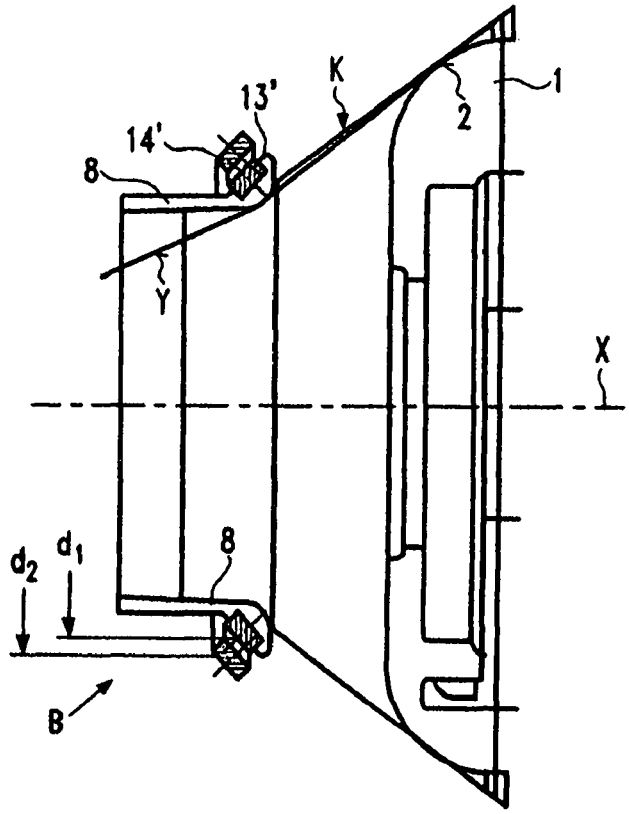
FIG. 15 is an axial section of another embodiment of a yarn braking device.

The embodiment in FIG. 15 contains two ring-shaped (conical ring) permanent magnets 13', 14' having rectangular cross-sections (respectively repelling permanent magnets). The outer permanent magnet 14' is provided on a larger diameter d2 while the inner permanent magnet 13' is provided on a smaller diameter d1, in order to achieve, as explained for FIG. 16, a larger radial range within which the inner permanent magnet 13' in case of a displacement is returned into the centered position by the increasing force from the outer permanent magnet 14'.

Figure 17:
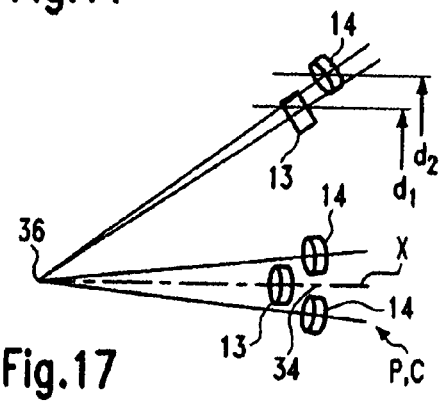

The principle of the magnet effect which acts obliquely to the axis X of the yarn braking device cannot only be realised with ring-shaped permanent magnets, but also can be achieved as shown in FIG. 17 even with single permanent magnets 13, 14 which e.g. may be cylindrical discs or cuboid-shaped blocks, respectively. The permanent magnets 13, 14 respectively are distributed pairwise around the circumference of the yarn braking device. The inner single permanent magnets 13 are connected e.g. to the carrying ring 37 or to another holding means. The permanent magnets 13, 14 are aligned to each other such that the magnet effect is directed obliquely, e.g. towards a point of intersection 36 with the axis X in order to generate the axial force and at the same time the radial force components. The permanent magnets 14 expediently are arranged at a larger diameter d2 than the inner permanent magnets 13. In order to prevent the permanent magnets 13, 14 being rotated in relation to each other about the axis X the permanent magnets 13, 14 are offset in circumferential direction such that they face the respective gaps between two adjacent other permanent magnets. That is, each permanent magnet 13 at the same time is actuated magnetically and obliquely with forces from two outer permanent magnets 14. A gap between the outer permanent magnets 14 e.g. is indicated with reference numeral 34. The inner single permanent magnet 13 is aligned to this gap 34. The directions of the actions between the outer and the inner permanent magnets 13, 14 need not be directed to the same point of intersection 36 on the axis X, but the directions of the actions of the outer repelling permanent magnets 14 as well could intersect the axis X further to the left side than at the point of intersection 36. Thanks to this arrangement the co-acting permanent magnets 13, 14 constitute the axial force generator P and the centering device, in particular, without any mechanical contact, and as soon as the braking body K is pressed against the storage body 1. The permanent magnets 13 could be provided directly at the braking body K or could even be integrated into the material of the braking body K, respectively.

The coil or the coils 39, 39' expediently are connected to a current control device and a current adjusting device. In order to improve the action of the coil iron material, in particular soft iron could be placed in the vicinity of the coil. In case that a circular knitting machine having many such yarn feeding devices which are equipped with such yarn braking devices B, all coils 39, 39' expediently could be controlled by a central current control device and current adjustment device in order to change the axial forces in the yarn braking devices of those yarn feeding devices jointly and independent from the value of the respective pre-adjusted axial force by an e.g. equal amount. In this fashion a trend to a deterioration of the quality of the knitted fabric, caused by a drift or fluctuation of the knitting yarn tension can be compensated for comfortably.

The invention claimed is:

1. Yarn braking device for a yarn feeding device, the yarn braking device comprising an axially stiff, radially deformable braking body with the shape of a frustocone, a large diameter end of the braking body being positioned coaxially over a rounded withdrawal end of a drum-shaped storage body and being pressed resiliently against the withdrawal end from a small diameter end of the braking body by an axial force defining the braking effect between the braking body and the withdrawal end, an axial force generator acting in the axial direction and a centering device acting in the radial direction, respectively, between a stationary holder and the braking body, wherein the axial force generator and the centering device at the same time are formed by at least one pair of permanent magnets, of which one permanent magnet of said pair is supported against the holder while the other permanent magnet of the pair is supported against the braking body, and the permanent magnets of the pair are aligned to each other via an intermediate gap such that the direction of the action of the magnet force between the permanent magnets is inclined obliquely towards the axis of the yarn braking device, and the permanent magnets of the pair generate both axial and radial force components to urge the braking body axially against the withdrawal end of the storage body and to effect centering of the braking body relative to the withdrawal end.

2. Yarn braking device as defined in claim 1, wherein the pair of permanent magnets comprises repelling permanent magnets.

3. Yarn braking device as defined in claim 2, wherein multiple said pairs of permanent magnets are distributed in a circumferential direction around said axis.

4. Yarn braking device as defined in claim 1, wherein the permanent magnets of the pair are both ring-shaped.

5. Yarn braking device as defined in claim 1, wherein, relative to the axis, said one permanent magnet is provided on a larger diameter than said other permanent magnet.

6. Yarn braking device as defined in claim 1, wherein the permanent magnets of the pair have repelling surfaces which are facing each other, the repelling surfaces are inclined obliquely towards the axis, and the repelling surfaces are substantially parallel to each other.

7. Yarn braking device as defined in claim 1, wherein the permanent magnets of the pair are ring-shaped truncated conical rings.

8. Yarn braking device as defined in claim 1, wherein said other permanent magnet is carried by a support ring body, and a conical support cage is detachably secured to the holder such that the support cage surrounds the small diameter end of the braking body, and the support cage is provided with a carrying ring at its small diameter end, which said carrying ring carries said one permanent magnet.

9. Yarn braking device as defined in claim 8, wherein the support ring body has an essentially cylindrical extension.

10. Yarn braking device as defined in claim 9, wherein the cylindrical extension of the support ring body, at an outer end, has an outwardly directed catching projection protruding outwardly beyond the carrying ring.

11. Yarn braking device as defined in claim 8, wherein a clearance distance at least of the size of the intermediate distance between faces of the permanent magnets of the pair is provided between the support ring body and the carrying ring.

12. Yarn braking device as defined in claim 1, wherein, at the small diameter end of the braking body, a cylindrical extension is formed on the frustocone coat.

13. Yarn braking device as defined in claim 1, wherein at least one coil is provided which can be selectively supplied with current and which is functionally associated with one of the permanent magnets of the axial force generator, and the coil is adapted to generate an auxiliary magnet force which acts essentially in the same direction as the axial force or counter to the direction of the axial force and which is superimposed to the axial force of the magnets.

14. Yarn braking device as defined in claim 13, wherein the coil is provided stationarily outside of the braking body and is associated with the permanent magnet which is supported at the braking body.

15. Yarn braking device as defined in claim 13, wherein the coil is supported at the braking body and is functionally associated with the permanent magnet which is provided stationarily outside of the braking body.

16. A non-controlled yarn braking device for use in conjunction with a yarn feeding device, comprising in combination:

a drum-shaped storage body having a longitudinal axis extending centrally thereof, the storage body at one end thereof defining a rounded withdrawal end extending circumferentially around the axis and over which a yarn is withdrawn from the body;

an axially stiff, radially deformable braking body of a frustoconical shape disposed adjacent said one end of said drum-shaped storage body in generally coaxial alignment therewith, the braking body having a large diameter end thereof positioned generally coaxially over and around the rounded withdrawal end of the drum-shaped storage body with the braking body projecting axially outwardly therefrom so as to terminate at a small diameter end;

a stationary holder structure positioned adjacent and radially outwardly of said braking body; and a permanent magnet structure cooperating between said holder structure and said braking body for axially urging the brake body into resilient pressing contact with the withdrawal end of the storage body and for additionally radially centering the braking body for contact with the withdrawal end;

said permanent magnet structure including at least one pair of permanent magnets, a first magnet of said pair being supported on said holder structure and a second magnet of the pair supported on said braking body, the permanent magnets of the pair being disposed in aligned relationship while separated from one another by an intermediate gap such that the direction of the magnetic force created by the permanent magnets extends in a direction which is inclined obliquely toward the axis whereby the pair of permanent magnets generate both axial and radial force components which urge the braking body axially against the withdrawal end of the storage body and which effect centering of the braking body relative to the withdrawal end;

whereby said braking body, other than its contacting engagement with the withdrawal end of the storage body, is otherwise free of mechanical contact.

17. A yarn braking device as defined in claim 16, wherein the first and second permanent magnets are repelling magnets.

18. A yarn braking device according to claim 16, wherein each of the first and second permanent magnets comprises a one-piece ring-shaped member, and wherein the ring-shaped members defining said first and second permanent magnets are disposed in close proximity to one another in substantially concentric and encircling relationship relative to said axis.

19. A yarn braking device as defined in claim 18, wherein the ring-shaped member defining said first permanent magnet has a diameter which is greater than the diameter of the ring-shaped member defining the second permanent magnet.

20. A yarn braking device as defined in claim 16, wherein said holder structure includes a sleeve-shaped support body which encircles said braking body and mounts said first permanent magnet thereon, and said first and second permanent magnets being positioned in close proximity to the small diameter end of said braking body.

* * * * *